United States Patent [19]

Hayakawa et al.

[11] Patent Number: 4,934,748

[45] Date of Patent: Jun. 19, 1990

[54] DOOR LOCK APPARATUS

[75] Inventors: Shigeru Hayakawa, Chiryu; Masao Ohhashi, Kariya; Yoshimasa Ishiguro, Toyota, all of Japan

[73] Assignee: Aisin Seiki Kabushiki Kaisha, Japan

[21] Appl. No.: 284,024

[22] Filed: Dec. 14, 1988

[30] Foreign Application Priority Data

Dec. 15, 1987 [JP] Japan ..... 62-190385

[51] Int. Cl.[5] ..... E05B 9/06

[52] U.S. Cl. ..... 292/337; 292/DIG. 53; 292/336.3

[58] Field of Search ..... 24/297; 411/504, 501, 411/500; 292/201, 216, 337, DIG. 53, DIG. 54, 336.3

[56] References Cited

U.S. PATENT DOCUMENTS

| | | | |
|---|---|---|---|
| 3,432,198 | 3/1969 | Connor | 292/216 |
| 3,876,238 | 4/1975 | Watermann | 292/216 |
| 4,647,092 | 3/1987 | Nakamura | 292/216 |
| 4,756,563 | 7/1988 | Garwood et al. | 292/337 X |
| 4,762,349 | 8/1988 | Ikeda | 292/216 |
| 4,775,176 | 10/1988 | Ikeda | 292/337 X |

*Primary Examiner*—Eric K. Nicholson

*Attorney, Agent, or Firm*—Finnegan, Henderson, Farabow, Garrett & Dunner

[57] ABSTRACT

A door lock apparatus includes a casing having a lock mechanism disposed therein, an actuating mechanism disposed on the casing to actuate the lock mechanism, and a protective member covering the actuating mechanism. The apparatus is provided with pins for retaining the actuating mechanism on the casing, and engagement portions are provided on the pins and the casing, respectively. The protective member is provided with retaining portions which are engageable with the engagement portions, respectively, so that the engagement portions and the retaining portions are fitted with each other to rigidly secure the protective member to the casing. Accordingly it is possible to mount the protective member firmly and easily. Since the protective member can be molded from a resin material, it is possible to lower the production cost and reduce the overall weight of the product. In addition, since there is no need for special means such as rivets, it is possible to mount the protective member at a reduced cost.

2 Claims, 4 Drawing Sheets

DOOR LOCK APPARATUS

BACKGROUND OF THE INVENTION

1. Field of the Invention

The present invention relates to a door lock apparatus and, more particularly, to a structure for attaching to a casing a protective member which covers an actuating mechanism of a door lock apparatus.

2. Description of the Related Art

A door lock apparatus such as that shown in FIG. 5 has heretofore been known. In this prior art, a base plate 101 on which an actuating mechanism 100 is mounted is provided with mounting bores 103, while a metallic protective member 102 which covers the actuating mechanism 100 is provided with mounting bores 104, and rivets 105 are respectively inserted into two pairs of aligned bores 103 and 104 and the headless end then flattened, thereby rigidly securing the protective member 102 to the base plate 101 and thus covering the actuating mechanism 100 with the protective member 102.

The above-described prior art suffers, however, from the disadvantage that, since the protective member 102 is rigidly secured to the base plate 101 by flattening the rivets 105, a troublesome and complicated operation, is required to mount the protective member 102, which results in a rise in, the production cost.

SUMMARY OF THE INVENTION

In view of the above-described disadvantage of the prior art, it is a primary object of the present invention to provide a door lock apparatus which is designed so that it is possible to mount a protective member with ease and at a lowered cost.

To achieve the objects and in accordance with the purpose of the invention, as embodied and broadly described herein, the door lock apparatus of this invention comprises a casing designed to have a lock mechanism disposed therein, an actuating mechanism disposed on the casing and designed to actuate the lock mechanism, and a protective member covering the actuating mechanism; a pin for retaining the actuating mechanism on the casing; first and second engagement portions which are provided on the pin and the casing, respectively; and first and second retaining portions provided on the protective member, the first and second retaining portions being engageable with the engagement portions, respectively, so that the first and second engagement portions and the retaining portions are fitted with each other to rigidly secure the protective member to the casing.

By virtue of the above-described arrangement, the protective member can be rigidly secured to the casing simply by fitting the engagement portions with the retaining portions, respectively. Thus, it is possible to mount the protective member with ease and at a reduced cost since there is no need for special means such as rivets.

BRIEF DESCRIPTION OF THE DRAWINGS

The above and other objects, features and advantages of the present invention will become more apparent from the following description of a preferred embodiment thereof, taken in conjunction with the accompanying drawings, in which like reference numerals denote like elements and, of which.

DESCRIPTION OF THE PREFERRED EMBODIMENT

One embodiment of the present invention will be described hereinunder in detail with reference to the accompanying drawings.

Figure 1:
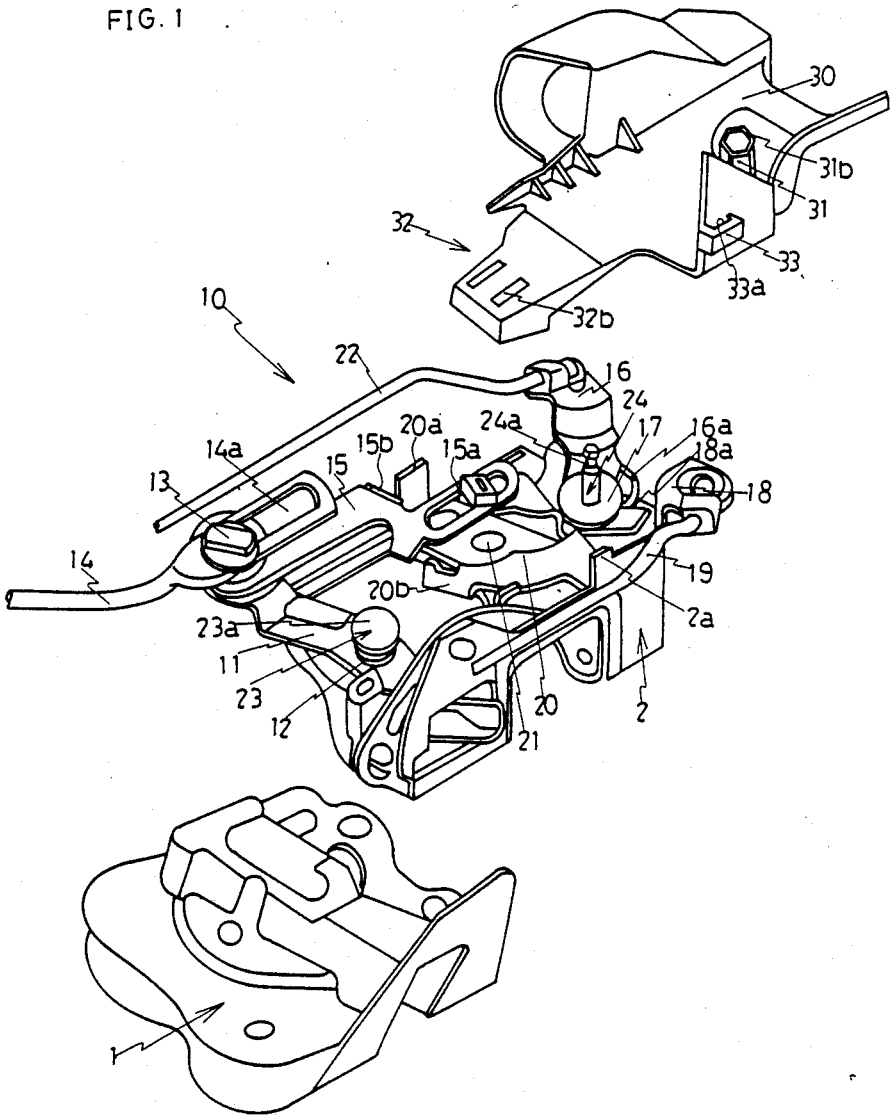
FIG. 1 is an exploded perspective view of one embodiment of the door lock apparatus according to the present invention.

Referring first to FIG. 1, a casing 1 has a lock mechanism (not shown) disposed therein, while a base plate 2 has an actuating mechanism 10 disposed thereon to actuate. the lock mechanism, the base plate 2 being secured to the upper side (as viewed in the figure) of the casing 1.

As shown in FIG. 1, an open lever 11 of the actuating mechanism 10 is pivotally retained on the base plate 2 by means of a pin 12. One end of the open lever 11 is operatively connected with an inside handle (not shown) provided on the indoor side of a door (not shown), while the other end of the open lever 11 is engaged with a slot **14*a* provided in a link 14 by means of a pin 13 so that the second end of the open lever 11 is linked with an outside handle (not shown) provided on the outdoor side of the door through the link 14 and also linked with one end of an open link 15 through the pin 13**.

A locking lever 16 of the actuating mechanism 10 is pivotally retained on the base plate 2 by means of a pin 17. One end of the locking lever 16 is linked through a link 22 with a locking button (not shown) provided on the indoor side of the door, while the other end of the locking lever 16 is engaged with the other end of the open link 15 through a slot **15*a*. Further, a key lever 18 is pivotally retained on the base plate 2 through the pin 17 in coaxial relation to the locking lever 16. On end of the key lever 18 is operatively connected with a key cylinder provided on the outdoor side of the door through a link 19. The other end of the key lever 18 is provided with a cut portion 18*a* such that the pin 17 is disposed in the center of the cut portion 18*a*. The cut portion 18*a* is engageble with an engagement portion 16*a* which is formed in the locking lever 16**.

Further, a lift lever 20 is pivotally retained on the base plate 2 through a pin 21. The lift lever 20 has a projection **20*a* formed at one end thereof, the projection 20*a* being engageable with an engagement portion 15*b* formed on the open link 15. The other end of the lift lever 20 is provided with an actuating portion 20*b*** with which the lock mechanism is actuated.

In the above-described arrangement, when the inside handle is pulled, the open lever 11 pivots about the pin 12 while pushing the open link 15. In consequence, the engagement portion **15*b* comes into contact with the projection 20*a* and pushes it, thus causing the lift lever 20 to pivot about the pin 21. As a result, the actuating portion 20*b* actuates the lock mechanism so as to unlock the door, thereby allowing the door to be opened. It should be noted that, when the outside handle is pulled, the open link 15 is directly actuated through the link 14** to conduct the same operation as the above. When the key (not shown) inserted into the key cylinder is turned, the link 19 is pushed to cause the key lever 18 to pivot about the pin 17. In consequence, one end of the cut portion 18*a* comes into contact with the engagement portion 16*a*, thus causing the locking lever 16 to pivot through the pin 17. As a result, the open link 15 pivots about the pin 13 so as to make it impossible for the engagement portion 15*b* to come into contact with the projection 20*a*. In this state, even if the inside or outside handle is pulled, the engagement portion 15*b* will not come into contact with the projection 20*a* and therefore the lift lever 20 will not pivot. Thus, the door is placed in a locked state. It should be noted that, when the locking button is pushed, the locking lever 16 is directly actuated through the link 22 to conduct the same operation as the above.

As shown in FIGS. 1 to 4, the pin 12 has an engagement portion 23 formed integral with its upper end, the engagement portion 23 having an annular projection 23*a* formed around the circumference. The pin 17 has an engagement portion 24 formed integral with its upper end, the engagement portion 24 having a recess 24*a* formed around the circumference. Further, the base plate 2 is provided with an engagement portion 2*a* which projects upward from the upper end thereof.

Figure 2:
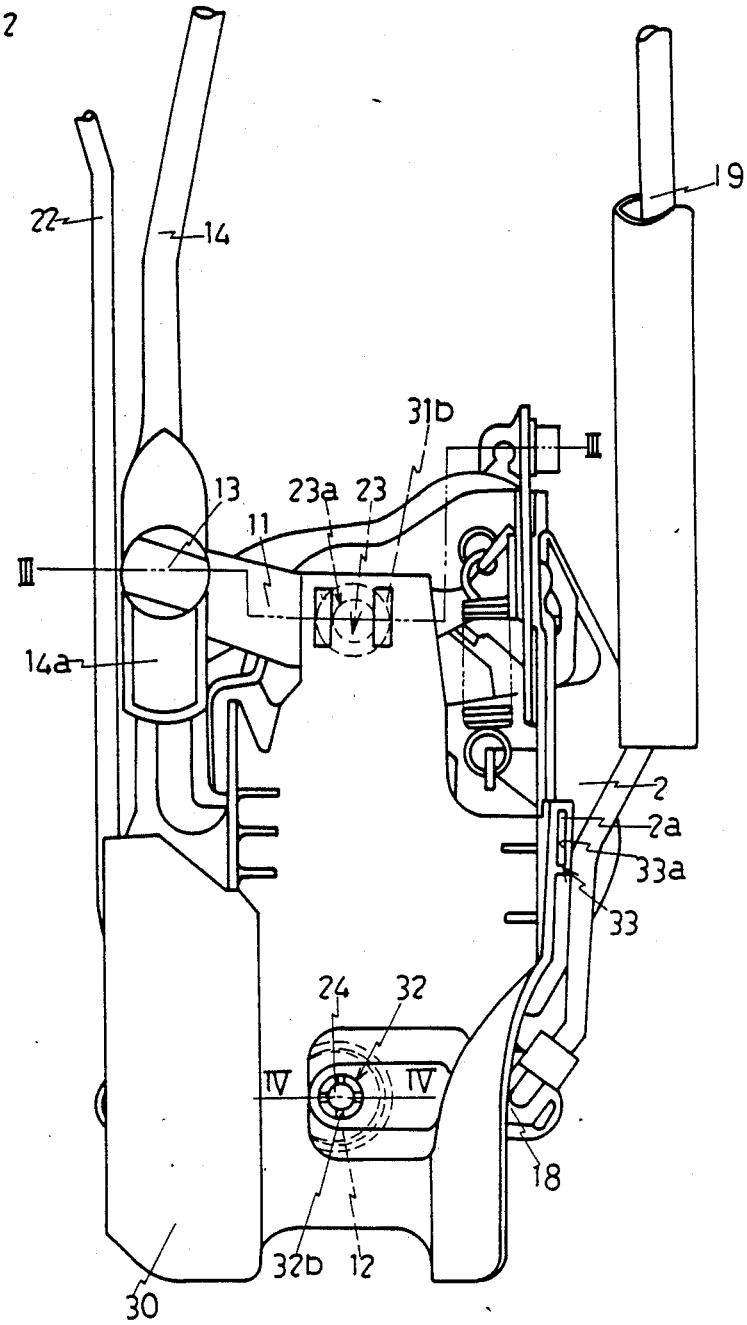
FIG. 2 is a plan view of the door lock apparatus shown in FIG. 1.
Figure 3:
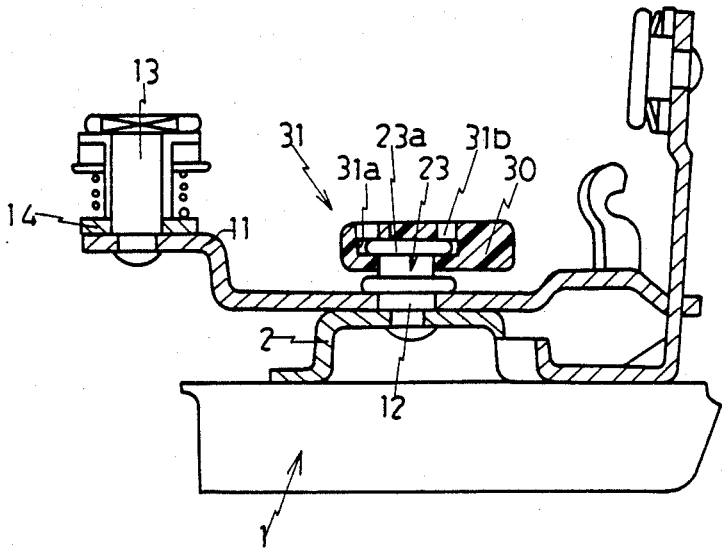
FIG. 3 is a sectional view taken along the line III—III of FIG. 2.
Figure 4:
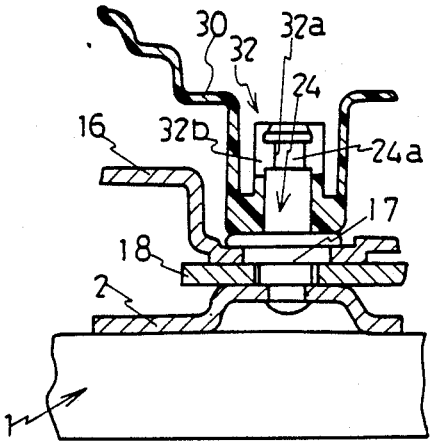
FIG. 4 is a sectional view taken along the line IV—IV of FIG. 2.
Figure 5:
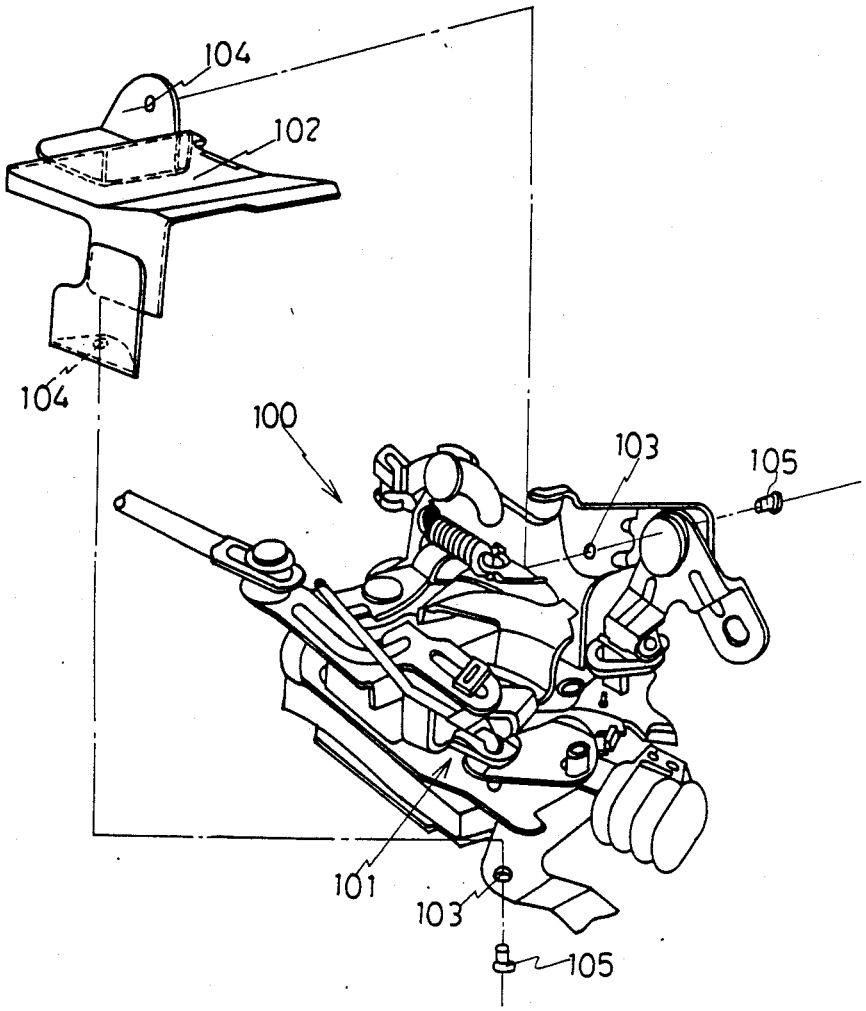
FIG. 5 PRIOR ART
FIG. 5 is an exploded perspective view of a door lock apparatus according to the prior art.

As shown in FIGS. 1 and 2, a protective member 30 made of a resin material is attached to the upper side of the actuating mechanism 10 such that the protective member 30 covers the actuating mechanism 10. Thus, the locking lever 16 and the key lever 18 are not exposed but covered with the protective member 30 and it is also possible to prevent the locking lever 16 from being forced to pivot from the outside by other means so as to unlock the door for the purpose, for example, of robbing.

The protective member 30 is provided with a retaining portion 31 into which the engagement portion 23 is inserted and which is provided with a recess 31*a* engaged with the projection 23*a* and a plurality of slits 31*b*, a retaining portion 32 into which the engagement portion 24 is inserted and which is provided with a projection 32*a* engaged with the recess 24*a* and a plurality of slits 32*b*, and a retaining portion 33 provided with a bore 33*a* into which the engagement portion 2*a* is inserted. Thus, through the fitting engagement between the engagement portions 23, 24, 2*a* and the retaining portions 31, 32, 33, the protective member 30 is attached to the upper side of the actuating mechanism 10 in such a manner that the protective member 30 covers the actuating mechanism 10. In this way, the protective member 30 can be readily and firmly mounted simply by fitting the engagement portions 23, 24, 2*a* with the retaining portions 31, 32, 33, respectively. Since there is no need for special means such as rivets, it is possible to mount the protective member 30 at a reduced cost. In addition, since the protective member 30 can be molded from a resin material, it is possible to lower the production cost and reduce the overall weight of the product.

As has been described above, the present invention provides a door lock apparatus including a casing having a lock mechanism disposed therein, an actuating mechanism disposed on the casing to actuate the lock mechanism, and a protective member covering the actuating mechanism, wherein the improvement comprises: a pin for retaining the actuating mechanism on the casing; engagement portions which are provided on the pin and the casing, respectively; and retaining portions provided on the protective member, the retaining portions being engageable with the engagement portions, respectively, so that the engagement portions and the retaining portions are fitted with each other to rigidly secure the protective member to the casing. Therefore, it is possible to mount the protective member firmly and easily. Since the protective member can be molded from a resin material, it is possible to lower the production cost and reduce the overall weight of the product. In addition, since there is no need for special means such as rivets, it is possible to mount the protective member at a reduced cost.

Although the present invention has been described through specific terms, it should be noted here that the described embodiment is not necessarily exclusive and various changes and modifications may be imparted thereto without departing from the scope of the invention which is limited solely by the appended claim.

What is claimed is:

1. A door lock apparatus comprising a casing designed to have a lock mechanism disposed therein, an actuating mechanism disposed on said casing and designed to actuate said lock mechanism, and a protective member covering said actuating mechanism; first and second pins for retaining said actuating mechanism on said casing; first and second engagement portions which are provided on said first pin and said casing, respectively, a third engagement portion provided on said second pin; first, second and third retaining portions provided on said protective member; said first and second retaining portions being engageable with said first and second engagement portions, respectively, said third retaining portion being engageable with said third engagement portion, so that said engagement portions and said retaining portions are fitted with each other to rigidly secure said protective member to said casing; and wherein said first and third retaining portions each include a plurality of slits to assist in engaging said first and third engagement portions, respectively.

2. A door lock apparatus as claimed in claim 1 wherein said second retaining portion contains a bore into which the second engagement portion is inserted.

* * * * *